US007970310B2

(12) United States Patent
Kidaka

(10) Patent No.: US 7,970,310 B2
(45) Date of Patent: Jun. 28, 2011

(54) IMAGE FORMING APPARATUS FOR SUPRESSING THE EFFECTS OF A BAND-LIKE TONER IMAGE

(75) Inventor: Hiroyuki Kidaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 11/843,282

(22) Filed: Aug. 22, 2007

(65) Prior Publication Data

US 2008/0080885 A1 Apr. 3, 2008

(30) Foreign Application Priority Data

Oct. 2, 2006 (JP) ..... 2006-270267

(51) Int. Cl.
*G03G 15/00* (2006.01)

(52) U.S. Cl. ..... 399/71

(58) Field of Classification Search ..... 399/66, 399/71, 101, 343
See application file for complete search history.

(56) References Cited

U.S. PATENT DOCUMENTS 5,287,149 A * 2/1994 Hoshika ..... 399/138
5,321,471 A * 6/1994 Ito et al. ..... 399/129
5,740,493 A * 4/1998 Otaki et al. ..... 399/71
6,081,679 A * 6/2000 Yamane et al. ..... 399/71
6,496,677 B2 * 12/2002 Fujimori ..... 399/298
7,321,741 B2 1/2008 Sakamaki et al.
2004/0213594 A1 * 10/2004 Takayanagi ..... 399/66
2005/0074249 A1 * 4/2005 Nishimura ..... 399/55
2006/0083527 A1 * 4/2006 Sakamaki ..... 399/50

FOREIGN PATENT DOCUMENTS

JP 2003-280483 10/2003
JP 2003280483 A * 10/2003

OTHER PUBLICATIONS

Machine English translation of JP2003-280483.*

* cited by examiner

*Primary Examiner* — David M Gray
*Assistant Examiner* — Billy J Lactaoen
(74) *Attorney, Agent, or Firm* — Fitzpatrick, Cella, Harper & Scinto

(57) ABSTRACT

In the image forming apparatus, in ending an image forming operation, a bias voltage having an opposite polarity from the transfer bias voltage is applied to the primary transfer device when at least a region passes through the primary transfer portion, the region passing through the development portion in a state in which the development bias voltage is applied in an uncharged region in the surface of the image bearing member after a charging operation of the charging device is stopped.

5 Claims, 5 Drawing Sheets

FIG.5

| | DEVELOPMENT BIAS VOLTAGE Vdc (V) | REVERSE TRANSFER BIAS VOLTAGE (kV) |
|---|---|---|
| (Y) | -550 | -3.7 |
| (M) | -580 | -3.9 |
| (C) | -600 | -4.0 |
| (K) | -530 | -3.5 |

IMAGE FORMING APPARATUS FOR SUPRESSING THE EFFECTS OF A BAND-LIKE TONER IMAGE

BACKGROUND OF THE INVENTION

1. Field of the Invention

The present invention relates to an image forming apparatus in which a toner image is formed on an image bearing member and an image is formed on a transfer material by transferring the toner image onto the transfer material.

2. Description of the Related Art

For a four-color full color image forming apparatus, an image forming apparatus including four (four colors) image forming portions which form toner images having different colors respectively is known. The four image forming portions are disposed from an upstream side to a downstream side along an intermediate transfer belt moving direction, the toner images having the different colors formed by the image forming portions are sequentially primary-transferred onto the intermediate transfer belt, and the four color toner images are superposed on the intermediate transfer belt. Then, the four color toner images on the intermediate transfer belt are collectively secondary-transferred onto a transfer material. Then, the four-color full color toner image is fixed on the transfer material by heating the four color toner images with a fixing device.

Application stop timing of a development bias voltage and a charging bias voltage in ending a recording operation (image forming operation) will be described below.

In each image forming portion, the charging performed by the charger driven during the image formation is ended in ending the recording operation. A development nip region is formed in a region where a surface of a photosensitive drum is in contact with a developer retained by a development sleeve of a development device. On the photosensitive drum surface, immediately after a rear end of a region (hereinafter referred to as "charged portion") which is charged by the image formation reaches the development nip region, the photosensitive drum surface close to the development sleeve becomes 0 V.

Accordingly, in the case where the development bias voltage (for example, −550 V) of the development sleeve is turned off after the rear end of the charged portion on the photosensitive drum passes through the development nip region, a large contrast potential Vcont (=|0−(−550)|=550 V) is formed in the whole region of the photosensitive drum surface passing through the development nip region, and the toner in the developer adheres to a non-image portion before the development is ended. As a result, a band-like toner image is formed at the rear end of the charged portion in ending the recording operation.

On the other hand, in order to prevent the adhesion of the toner to the non-image portion, it is necessary to turn off the development bias voltage of the development sleeve before the rear end of the charged portion in the photosensitive drum surface charged to a surface potential Vd (for example, −700 V) reaches the development nip region. However, under such circumstances, a part of the photosensitive drum surface charged to the surface potential Vd (−700 V) passes through the development nip region after the development bias voltage is turned off. At this point, a large fog removal potential Vback (=|−700−0|=700 V) is formed between the development sleeve and the photosensitive drum surface. Therefore, in the case where a two-component developer including the toner and a carrier is used as the developer, there is generated a problem in that the carrier in the developer adheres to the photosensitive drum surface.

In order to cause both the toner and the carrier not to adhere to the photosensitive drum surface, it is necessary that the development bias voltage be turned off at the same time the rear end of the charged portion on the photosensitive drum reaches the development nip region. In consideration of the actual various fluctuations, it is difficult to completely synchronize the turn-off timing in each time. Furthermore, because the development nip region has a predetermined width, it is difficult to synchronize the turn-off timing.

Accordingly, either the carrier or the toner on the development sleeve adheres to the photosensitive drum. Particularly when the carrier of the development sleeve jumps to the photosensitive drum, a cleaning blade of a cleaning device for cleaning the photosensitive drum surface causes the carrier to damage the photosensitive drum surface and to shorten the life of the photosensitive drum.

Therefore, conventionally the carrier adhesion is completely prevented by turning off the bias voltage applied to the development sleeve immediately after the rear end of the photosensitive drum surface charged to surface potential Vd (−700 V) by the charger reaches the development nip region, which forms the band-like toner image at the rear end of the charged portion in ending the recording operation.

Unlike the carrier, the cleaning blade hardly causes the toner to damage the photosensitive drum surface. In the conventional configuration, although a problem of increasing toner consumption is generated, the good image can be maintained for a long period while the adhesion of the carrier to the photosensitive drum is not increased (for example, see Japanese Patent Application Laid-Open No. 2003-280483).

On the other hand, because the same problem is generated in starting the recording operation, the development bias voltage applied to the development sleeve is turned on immediately before a leading end of the charged portion in the photosensitive drum surface charged to the surface potential Vd (−700 V) by the charger reaches the development nip region. However, in starting the recording operation, the toner in the development nip region is discharged onto the photosensitive drum in ending the recording operation, and only a trace of the toner remains in the development nip region. Therefore, the formation of the band-like toner image becomes minor compared with the band-like toner image in ending the recording operation.

As described above, in ending the recording operation, when the above configuration is used as allocation stop timing of the development bias voltage and charging bias voltage, the band-like toner image is formed at the rear end of the charged portion although the carrier does not adhere to the photosensitive drum.

The band-like toner image is transferred tentatively to the intermediate transfer belt by a primary transfer roller, and the band-like toner image is removed and recovered by an intermediate transfer belt cleaning member located on the downstream side of a secondary transfer roller. Otherwise, the band-like toner image remains on the intermediate transfer belt, which causes in-machine contamination. Therefore, it is necessary to continuously rotate the intermediate transfer belt until the band-like toner image is conveyed to the intermediate transfer belt cleaning member and removed and recovered. However, there is generated a problem in that a long time is required for the rotation of the intermediate transfer belt in ending the recording operation.

Because the transfer material to be transferred does not exist in the band-like toner image when the band-like toner image is conveyed to the secondary transfer roller located on the upstream side of the intermediate transfer belt cleaning member, a part of the band-like toner image is transferred to the secondary transfer roller, which causes the contamination of the secondary transfer roller. In order to solve the above problems, a secondary transfer roller cleaner is provided to remove the contamination of the secondary transfer roller, and the contamination of the secondary transfer roller is decreased. Then, the band-like toner image is conveyed to the intermediate transfer belt cleaning member, and the intermediate transfer belt is continuously rotated to prevent the contamination in the machine until the band-like toner image is removed and recovered.

When the four-color full color image forming apparatus has the configuration of the bias stop timing in ending the recording operation, the band-like toner images are formed according to the bias stop timing of each color. The band-like toner images are transferred to the intermediate transfer belt as well as the four color toner images primary-transferred to the intermediate transfer belt by electric action and pressing force of the primary transfer roller.

Accordingly, in the four-color full color image forming apparatus, the four color band-like toner images contaminates the secondary transfer roller. Additionally, in the four color band-like toner images formed according to the bias stop timing of the colors, it is necessary to continuously rotate the intermediate transfer belt until the band-like toner image located on the uppermost stream side of the intermediate transfer belt is conveyed to the intermediate transfer belt cleaning member and removed and recovered. As a result, there is generated the problem in that a large amount of time is required for the rotation of the intermediate transfer belt in ending the recording operation.

Furthermore, as described above, in the band-like toner image, because the development bias voltage Vdc (550 V) is applied to the development sleeve when the photosensitive drum has the surface potential of 0 V, a development process is performed by the extremely high contrast potential Vcont (−550 V). Usually, from the standpoint of safety, a solid image portion on the photosensitive drum has a surface potential V1 smaller than the value of 0 V (for example, −200 V). As a result, compared with the contrast potential Vcont (=|V1−Vdc|=|−200+550|=350 V) in the usual solid image formation, a large amount of toner is placed on the band-like toner image formed at the rear end of the charged portion in ending the recording operation.

That is, in the four-color full color image forming apparatus, the four color band-like toner images which have the toner amounts larger than the toner amount corresponding to the solid image respectively are formed on the intermediate transfer belt in ending the recording operation.

In order to prevent the in-machine contamination, it is necessary that all the four color band-like toner images on the intermediate transfer belt be conveyed to the intermediate transfer belt cleaning member. However, when the band-like toner image is conveyed to the secondary transfer portion located in the course of conveyance, the band-like toner image comes into direct contact with the secondary transfer roller, and a part of the band-like toner image is transferred to the secondary transfer roller to contaminate the secondary transfer roller by the electric action and pressing force.

The contamination can be removed by the secondary transfer roller cleaner. However, sometimes the secondary transfer roller cleaner cannot remove the four color band-like toner images on which the extremely large amount of toner is placed by one-time cleaning. When a backside of the transfer material is brought into contact with the contaminated part in the next process, there is generated a problem in that the backside of the transfer material is contaminated. Sometimes the toner is hardly removed depending on a material of the secondary transfer roller. For example, the toner is hardly removed when a surface shape of the secondary transfer roller is roughened.

On the other hand, there is a method in which the secondary transfer roller is rotated more than once to completely clean the secondary transfer roller while the image is not formed and the transfer material is fed to resume the image formation. However, efficiency is reduced in the above method, because the image cannot be formed until the secondary transfer roller is sufficiently cleaned.

SUMMARY OF THE INVENTION

In view of the foregoing, an object of the invention is to prevent the problem caused by transferring the toner image generated in the end of the recording operation to the intermediate transfer member.

An image forming apparatus according to an aspect of the invention includes an image bearing member; a charging device which charges a surface of the image bearing member; a developer bearing member which bears a developer including a toner and a carrier; a development device which develops an electrostatic image in a development portion by applying a development bias voltage to the developer bearing member, the electrostatic image being formed in the image bearing member; a primary transfer device which transfers a developer image to an intermediate transfer member in a primary transfer portion by applying a transfer bias voltage, the developer image being formed on the image bearing member; a secondary transfer device which transfers the developer image from said intermediate transfer member to a transfer material in a secondary transfer portion; and a cleaning device which removes the developer on the surface of the image bearing member, wherein, in ending an image forming operation, a bias voltage having an opposite polarity from the transfer bias voltage is applied to the primary transfer device when at least a region passes through the primary transfer portion, the region not having been charged by the charging device, and passing the development portion in a state which the development bias voltage is applied.

BRIEF DESCRIPTION OF THE DRAWINGS

FIG. 5 is a graph illustrating examples of the development bias voltage and reverse transfer bias voltage.

DETAILED DESCRIPTION OF THE PREFERRED EMBODIMENTS

An image forming apparatus according to an exemplary embodiment of the invention will specifically be described with reference to the drawings.

(Overall Configuration)

Figure 1:
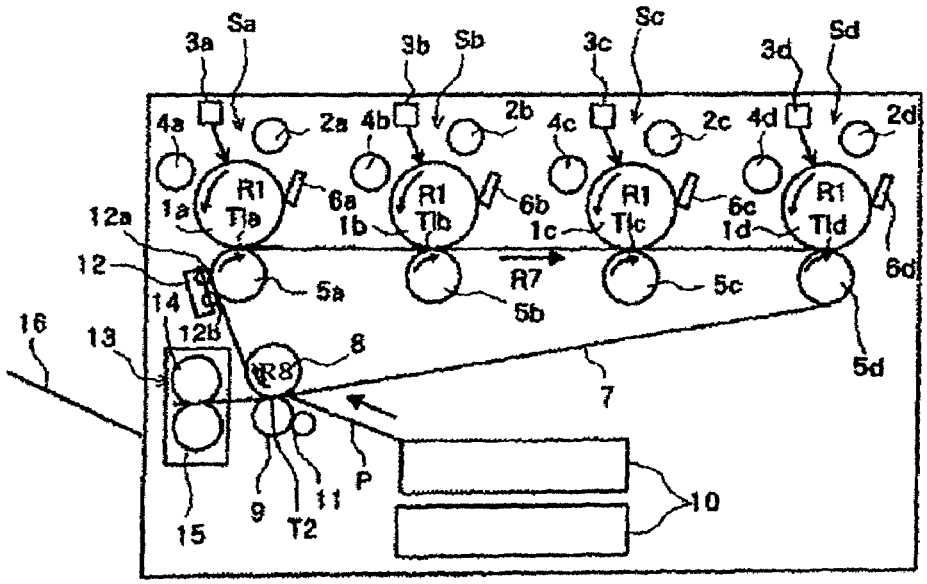
FIG. 1 is a schematic sectional view illustrating an image forming apparatus according to an exemplary embodiment of the invention.

FIG. 1 is a schematic overall view illustrating an image forming apparatus according to an exemplary embodiment of the invention. The image forming apparatus illustrated in FIG. 1 is a four-color full color electrophotographic image forming apparatus having four image forming portions which form yellow, magenta, cyan, and black color images respectively.

In the image forming apparatus illustrated in FIG. 1, four image forming portions Sa, Sb, Sc, and Sd are disposed from an upstream side to a downstream side along a rotational direction (direction of an arrow R7) of an intermediate transfer belt 7 which is of an intermediate transfer member.

In FIG. 1, although the letters a, b, c, and d designate members corresponding to the yellow, magenta, cyan, and black image forming portions respectively, the letters a, b, c, and d are neglected in the following description unless the colors are required to particularly differentiate from one another.

The image forming portion S is one which forms a toner image of each of the yellow, magenta, cyan, black colors. The image forming portion S includes a drum-shape electrophotographic photosensitive member (hereinafter referred to as "photosensitive drum") 1 which can be rotated as an image bearing member.

The photosensitive drum 1 is rotated in a direction of an arrow R1 (counterclockwise in FIG. 1). A charger (charging means) 2, an exposure device (latent image forming means) 3, a development device (development means) 4, a primary transfer roller (primary transfer means) 5, and a drum cleaner (cleaning device) 6 are sequentially disposed around the photosensitive drum 1 along the rotational direction of the photosensitive drum 1.

The endless intermediate transfer belt 7 is entrained about the primary transfer roller 5 and a secondary transfer counter roller 8. The intermediate transfer belt 7 is pressed from a backside by the primary transfer roller 5, and a surface of the intermediate transfer belt 7 abuts on the photosensitive drum 1. This allows a primary transfer nip (primary transfer portion) T1 between the photosensitive drum 1 and the intermediate transfer belt 7. The intermediate transfer belt 7 is rotated in the direction of the arrow R7 as the secondary transfer counter roller 8 which is also used as a driving roller is rotated in a direction of an arrow R8. The intermediate transfer belt 7 is set to the same rotational speed as a rotational speed (process speed) of the photosensitive drum 1.

A secondary transfer roller (secondary transfer means) 9 is disposed at a position corresponding to the secondary transfer counter roller 8 in the surface of the intermediate transfer belt 7. The intermediate transfer belt 7 is nipped between the secondary transfer roller 9 and the secondary transfer counter roller 8, and a secondary transfer nip (secondary transfer portion) T2 is formed between the secondary transfer roller 9 and the intermediate transfer belt 7. A roller cleaner (secondary transfer member cleaner) 11 abuts on the secondary transfer roller 9. A belt cleaner (intermediate transfer member cleaner) 12 abuts on the surface of the intermediate transfer belt 7 to the position corresponding to the primary transfer roller 5*a*. The belt cleaner 12 includes cleaning member 12*a* and 12*b* which perform cleaning while abutting on the intermediate transfer belt.

A transfer material P used for the image formation is stored in a sheet cassette 10 while stacked. The transfer material P is fed to the secondary transfer nip portion T2 by a feeding and conveyance device (not illustrated) including a feeding roller, a conveyance roller, and a registration roller. A fixing device 13 is disposed on the downstream side of the secondary transfer nip portion T2 along a conveyance direction of the transfer material P. The fixing device 13 includes a fixing roller 14 and a pressure roller 15 pressed against the fixing roller 14. A discharge tray 16 is disposed on the downstream side of the fixing device 13.

(Image Forming Operation)

In the image forming apparatus having the above configuration, the four-color full color toner image is formed on the transfer material P as follows.

The photosensitive drum 1 is rotated at a predetermined process speed in the arrow direction by a photosensitive drum driving motor (not illustrated), and the photosensitive drum 1 is evenly charged to a predetermined polar potential by the charger 2. After the charging, in the photosensitive drum 1, the exposure is performed by the exposure device 3 based on image information, and the charge in the exposed part is eliminated to form an electrostatic latent image in each color.

The electrostatic latent image on the photosensitive drum 1 is developed as each toner image of the yellow, magenta, cyan, black colors by the development device 4. A transfer bias voltage is applied at a primary transfer nip T1 by the primary transfer roller 5, which allows the four color toner images to be sequentially primary-transferred onto the intermediate transfer belt 7. Thus, the four color toner images are posed on the intermediate transfer belt 7. The toner (residual toner) which remains on the photosensitive drum 1 while being not transferred onto the intermediate transfer belt 7 during the primary transfer is removed by the drum cleaner 6. The photosensitive drum 1 in which the residual toner is removed is used for the next image formation.

Thus, the four color toner images superposed on the intermediate transfer belt 7 are secondary-transferred to the transfer material P. The transfer material P conveyed by the feed and conveyance device is fed to the secondary transfer nip T2 in synchronization with the toner image on the intermediate transfer belt 7 by the registration roller. Then, the four color toner images on the intermediate transfer belt 7 are collectively secondary-transferred to the transfer material P at the secondary transfer nip T2 by the secondary transfer roller 9. The toner (residual toner) which remains on the intermediate transfer belt 7 while being not transferred onto the transfer material P during the secondary transfer is removed by the belt cleaner 12.

On the other hand, the transfer material P to which the four color toner images are secondary-transferred is conveyed to the fixing device 13. In the fixing device 13, the transfer material P is heated and pressurized, and the toner image is fixed onto the surface of the transfer material P. After fixing the toner image, the transfer material P is discharged onto a discharge tray 16. Thus, the four-color full color image formation is ended for one side (surface) of the transfer material P.

(Relationship Between Development and Development Bias Voltage)

Figure 2:
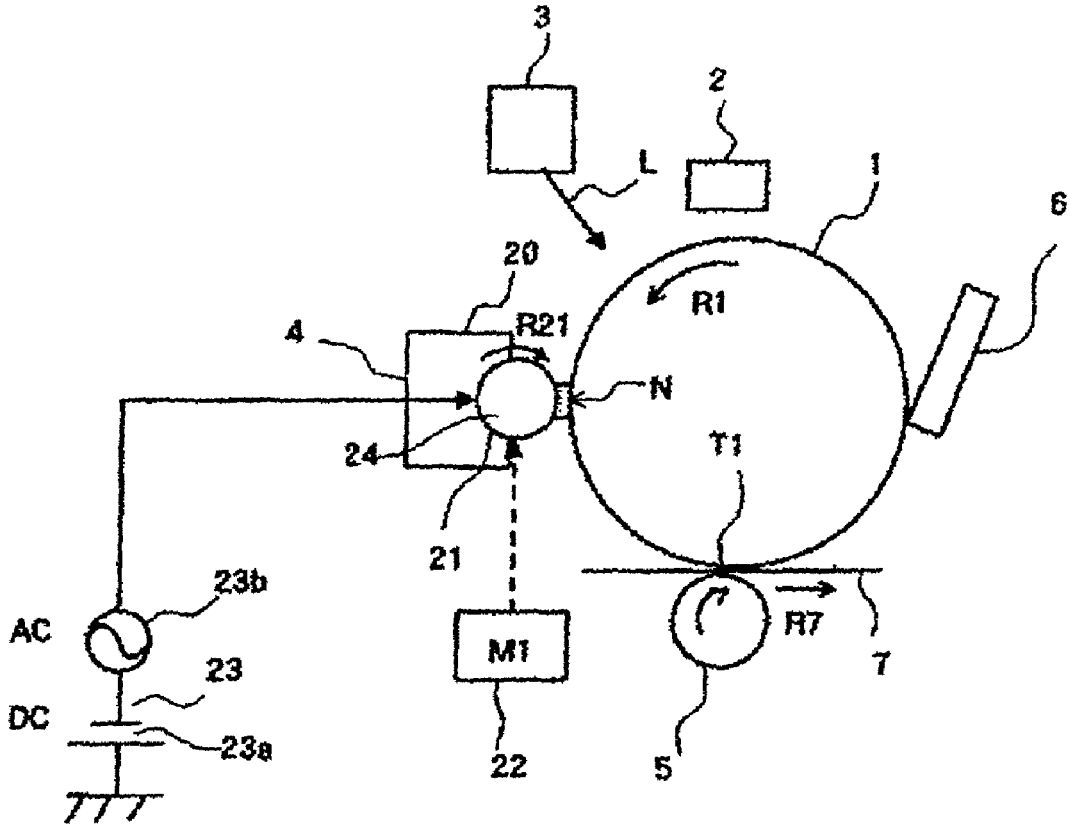
FIG. 2 is an enlarged sectional view illustrating the components around a photosensitive drum.

FIG. 2 is an enlarged view illustrating the components around photosensitive drum 1.

In the image formation, the photosensitive drum 1 is rotated at the predetermined process speed in the direction of the arrow R1 by the photosensitive drum driving motor, the photosensitive drum 1 is evenly charged to the predetermined polar potential by the charger 2. In the embodiment, the photosensitive drum 1 is charged to a surface potential (dark-portion potential) Vd=−700 V. After the charging, the exposure device 3 performs exposure L to the surface of the photosensitive drum 1 based on the image information, and the charge in the exposed part is eliminated to form the electrostatic latent image. Hereinafter the part in which the electrostatic latent image is formed by the exposure is referred to as "image portion (bright portion)" and the part to which the exposure is not performed is referred to as "non-image portion (dark portion)". The image portion has a potential (for example, bright-portion potential V1=−200 V) higher than that of the non-image portion.

The development device 4 is disposed on the downstream side of the charger 2 along the rotational direction (direction of the arrow R1) of the photosensitive drum 1. The development device 4 includes a development container 20 in which a developer is stored, a development sleeve 21 which is of a developer bearing member, a motor 22 which rotates the development sleeve 21, and a development bias applying power supply 23 which applies a development bias voltage to the development sleeve 21.

The negatively-charged toner is borne on the surface of the development sleeve 21. The development bias applying power supply 23 applies the development bias voltage to the development sleeve 21. The application of the development bias voltage causes the toner borne on the surface of the development sleeve 21 to adhere to the image portion on the photosensitive drum 1 to form the toner image when the image portion of the photosensitive drum 1 passes by the neighbor of the development sleeve 21.

Conventionally, in the color image forming apparatus in which the full color image or multi color image is formed by the electrophotographic method, from the standpoint of color development property or color mixture property, a two-component developer in which a toner and a carrier are mixed together is used as the development device 4 in most cases. In the two-component development process, the development sleeve 21 retains the developer including the negatively-charged toner and the positively-charged carrier on the surface thereof. The development bias voltage is applied to the development sleeve 21 in order to cause the toner to jump to the image portion in the surface of the photosensitive drum 1. The development bias voltage is lower than the potential at the image portion, but higher than the potential at non-image portion.

Recently a (DC+AC) bias method is particularly adopted as the development bias voltage of the development sleeve 21 to improve development performance. In the (DC+AC) bias method, an AC component (for example, 2.0 kV) is superposed on a DC component (for example, Vdc=−550 V).

A difference between the dark-portion potential Vd of the non-image portion and the DC component Vdc of the development bias voltage is referred to as fog removal potential Vback (=|Vd−Vdc|), and the fog removal potential Vback is usually set to a range of about 100 to about 200 V. When the fog removal potential Vback is smaller than the above range, the fog is easily generated in the non-image portion. On the other hand, the fog removal potential Vback is larger than the range, a carrier adhesion amount tends to increase.

A difference between the bright-portion potential V1 of the non-image portion and the DC component Vdc of the development bias voltage is referred to as contrast potential Vcont (=|Vl−Vdc|), and the amount of toner placed on the photosensitive drum increases with increasing contrast potential Vcont. Usually density of the toner image on the photosensitive drum can be obtained by adjusting the contrast potential.

The development device 4 and the developer will be described in detail.

In the embodiment, a two-component magnetic brush method is adopted in the development device 4. A two-component developer is stored in the development container 20 of the development device 4 illustrated in FIG. 2. The two-component developer mainly includes a magnetic carrier particle (hereinafter referred to as "carrier") and a toner particle (hereinafter referred to as "toner"). A magnet roller 24 is disposed inside the development sleeve 21. The magnet roller 24 is rigidly attached and the outside development sleeve 21 is rotated in the direction of an arrow 21 by a motor 22.

A magnetic brush of the two-component developer is formed in the surface of the development sleeve 21 by a magnetic force of the magnet roller 24. A micro gap is provided between the surface of the photosensitive drum 1 and the surface of the development sleeve 24. The development sleeve 21 is rotated in the direction of the arrow R21 by the motor 22, whereby the surface magnetic brush is caused to slide on the surface of the photosensitive drum 1 or brought close to the surface of the photosensitive drum 1. Additionally, the development bias applying power supply 23 applies the development bias voltage to the development sleeve 21. Therefore, the toner in the magnetic brush in the surface of the development sleeve 21 adheres to the image portion of the photosensitive drum 1, and the image portion is developed as the toner image.

In the embodiment, the photosensitive drum 1 has a diameter of 80 mm, the development sleeve 21 has a diameter of 20 mm, and a distance of the nearest region (development portion) between the surface of the photosensitive drum 1 and the surface of the development sleeve 21 is set to about 400 μm. Hereinafter the development portion is referred to as development nip region N. Therefore, the development can be performed while the developer conveyed to the development nip region N by the rotation of the development sleeve 21 in the direction of the arrow R21 is in contact with the photosensitive drum 1.

At this point, in the embodiment, the development bias voltage in which the direct-current component (DC component) is superposed on the alternating-current component (AC component) is applied to the development sleeve 21 using a development bias applying power supply. The development bias applying power supply includes a direct-current bias power supply 23*a* and an alternating-current bias power supply 23*b*. The application of the development bias voltage forms an oscillating electric field between the photosensitive drum 1 and the development sleeve 21. The oscillating electric field allows the toner to separate from the carrier and fly. In the embodiment, an alternating-current bias having a frequency f of 12 kHz and a peak-to-peak voltage Vpp of 1.85 kV is used as the AC component.

(Bias Control During Recording Operation)

Contents of control of the development bias voltage, driving control of the photosensitive drum 1, and driving control of the development sleeve 21 in the start and the end of the recording operation (image forming operation) will be described in detail with reference to FIGS. 2 and 3.

Figure 3:
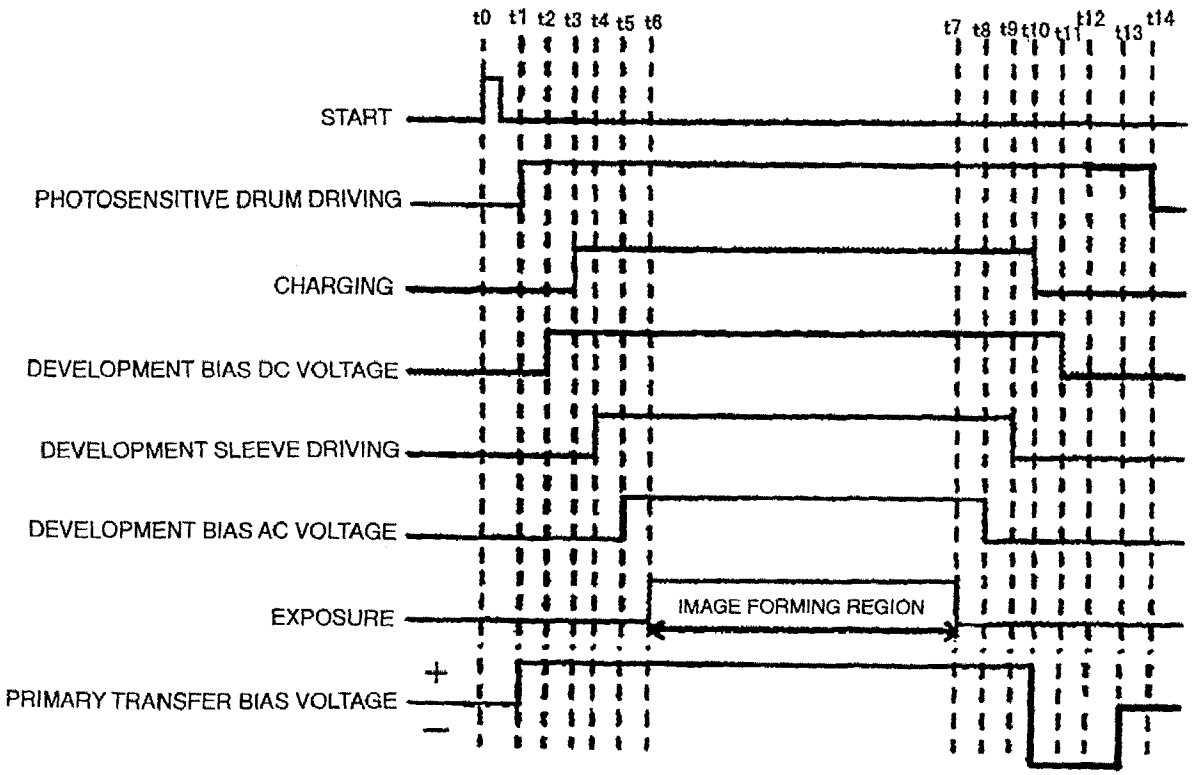
FIG. 3 is a timing chart explaining timing of driving, charging, development, exposure, primary transfer of a photosensitive drum.

FIG. 3 illustrates a timing chart of the driving, charging, development, and exposure of the photosensitive drum until the recording operation is ended since the recording operation is started in the case where copying (image formation) is performed to the one transfer material P. In FIG. 3, the timing chart illustrated based on the development nip region N.

A start key (not illustrated) in an operation panel of the image forming apparatus main body is pressed at a time t0, and the driving of photosensitive drum driving motor is started at a time t1.

When the photosensitive drum 1 to which the rotational driving force of the photosensitive drum driving motor is transmitted is stably rotated, the charger 2 is controlled to start the application of the charging voltage (Vd=−700 V) to the photosensitive drum 1. Therefore, the photosensitive drum surface passing through the portion where the charger 2 faces the photosensitive drum 1 is charged to −700 V. The charged portion reaches the development nip region N by the rotation of the photosensitive drum 1.

In the embodiment, the control is performed such that the DC component (Vdc=−550 V) of the development bias voltage is applied to the development sleeve 21 immediately before a time t2 at which a leading end on the downstream side in the photosensitive drum rotating direction of the charged portion reaches the development nip region N.

At the time t2, the photosensitive drum surface located in the development nip region N has the potential of 0 V because the photosensitive drum surface is the uncharged region. On the other hand, the DC bias voltage of −550 V is applied to the development sleeve 21, so that the toner can adhere to the photosensitive drum surface located in the development nip region N at the contrast potential Vcont of 550 V. Immediately after the toner adheres to the photosensitive drum surface, because the charged region of the photosensitive drum surface charged at 750 V enters the development nip region N, the development potential is increased from −550 V to +200 V (=−550−(−750)) in the development nip region N. Therefore, the adhesion of the toner to the photosensitive drum surface is stopped from then on. Accordingly, the band-like toner adheres to the photosensitive drum surface located in the development nip region N.

As described in the conventional technique, when the development bias voltage is applied after the charged portion passes through the development nip region N, the adhesion of the toner can be prevented although instead the carrier adheres to the photosensitive drum surface. In the embodiment, the band-like toner image is permitted because a high priority is put on the prevention of the carrier adhesion from the standpoint of large adverse effect caused by the carrier adhesion.

At this point, the amount of toner adhering to the photosensitive drum surface depends on a relative potential between the photosensitive drum surface in the development nip region N and the development sleeve surface. When the bias voltage of the development sleeve 21 has only the DC component, the toner adhesion amount can considerably reduced compared with the (DC+AC) bias voltage in which the AC component is superposed on the DC component. The application of the (DC+AC) bias voltage has a development ability much higher than that of the DC component.

Therefore, in the embodiment, only the DC component is applied as the development bias voltage until the charged portion reaches the development nip region N, which allows the band-like toner adhesion amount to be decreased. Additionally, the adhesion amount is not increased (instead the carrier is difficult to adhere to the photosensitive drum surface).

In the embodiment, as illustrated in FIG. 3, the development sleeve 21 which is driven by a driving system different from the photosensitive drum 1 is not rotated yet, when the rotation of the photosensitive drum 1 is started at the time t1. The development sleeve 21 is controlled so as to be rotated at a time t4. The time t4 belongs to a period until the leading end of the image portion reaches the development nip region N after the leading end of the charged portion passes through the development nip region N.

The above control has the following advantage. As described above, the toner is developed by the high contrast potential while the charged portion passes through the development nip region N. At this point, when the development sleeve 21 is driven, the toner is continuously supplied to the development portion, which possibly results in the widened band-like toner image. Particularly this phenomenon appears remarkably in the image forming apparatus having a high process speed.

On the other hand, when the driving of the development sleeve 21 is stopped, almost all the toner jumping from the development sleeve 21 to the side of the photosensitive drum 1 is toner which adheres to the position facing the photosensitive drum 1. Immediately after the DC-component bias voltage is applied to the development sleeve 21, the toner which adheres to the position facing the photosensitive drum 1 jumps to the side of the photosensitive drum 1, and the toner does not adhere to the position any more at the time the band having the development nip width is formed. Therefore, the toner adhesion band width can be suppressed to an extent of the development nip width.

When a predetermined time elapses since the DC-component bias voltage is applied to the development sleeve 21, a part corresponding to the leading end position of the transfer material P in the photosensitive drum surface reaches the exposure position by the rotation of the photosensitive drum 1. At a time t5 when a predetermined time corresponding to a distance between the leading end of the transfer material and the recording start position elapses, a part corresponding to the leading end position of the image size (identical to the leading end of the image portion) reaches the exposure position.

The exposure device 3 completes preparation for electrostatic latent image formation by the exposure by a time t6, and the exposure device 3 starts the electrostatic latent image formation from the leading end of the image size in which the image appears. The exposed part in the photosensitive drum surface is charged to the potential at which the toner adheres to the exposed part while the carrier does not adhere to.

On the other hand, at the time t5 immediately before the time the recording start position in the photosensitive drum surface reaches the development nip region N, the AC-component bias voltage is superposed on the DC-component bias voltage in the development sleeve 21. That is, the AC-component bias voltage is superposed on the DC-component bias voltage before the latent image start point in the photosensitive drum surface reaches the development nip region N by the rotation of the photosensitive drum 1.

Therefore, when the recording start position passes through the development nip region N, the development is performed by the bias voltage in which the AC component is superposed on the DC component. The bias voltage in which the AC component is superposed on the DC component has the higher development ability compared with the single DC-component bias voltage.

As used herein, the recording start position means a leading end of the image-formable region. Even if the image does not exist actually at the leading end of the image-formable region, the AC-component bias voltage is superposed on the DC-component bias voltage to the development sleeve 21 when the image-formable region reaches the development nip region N. However, when the latent image is not formed from the leading end of the image-formable region, the AC-component bias voltage may be superposed after the latent image start point is brought closest to the development nip region N. Therefore, the unnecessary adhesion of the toner and carrier can further be reduced.

In the embodiment, the superposition of the AC component bias voltage to the development sleeve 21 is started after the driving of the development sleeve 21 is started and vice versa. The adhesion of the toner or carrier to the photosensitive drum 1, caused by accidental shock in starting the driving of the development sleeve, can be suppressed by the configuration of the embodiment.

To sum up the bias voltage control in starting the recording operation, the driving of the photosensitive drum 1 is started after the copy start button is pressed, and the charging is started when the driving of the photosensitive drum 1 is stabilized. Then, the DC-component bias voltage of the development bias power supply is applied before the leading end of the charged portion of the photosensitive drum 1 reaches the development nip region N. Then, the driving of the development sleeve 21 is started until the leading end of the image size reaches the development nip portion, the AC-component bias voltage is superposed on the DC-component bias voltage, and the development process is performed.

(Bias Control in Ending Recording Operation)

The bias voltage control in ending the recording operation will be described below. Because the same effect is basically obtained when the control in starting the recording operation is reversely pursued, the same description as that in starting the recording operation is neglected, and only timing will briefly be described with reference to the timing chart of FIG. 3.

At a time t7 of the timing chart illustrated in FIG. 3, the latent image formation by the exposure is ended for one page on the photosensitive drum 1. After the latent image formation, the rear end of the image-formable region passes through the rear end of the development nip region N by the rotation of the photosensitive drum 1. In the embodiment, only the AC-component bias voltage is turned off in anticipation of the DC-component bias voltage at time t8 after the recording end position passes through the development nip region N. Additionally, the rotation of the development sleeve 21 is stopped at a time t9 before the rear end of the charged portion reaches the development nip region N. Then, the charging voltage of the charger 2 is turned off at a time t10.

After turning off the charging voltage, the DC component of the development bias voltage is turned off at a time t11 immediately after the rear end of the charged portion passes through the development nip region N by the rotation of the photosensitive drum 1. Then, the rotation of the photosensitive drum 1 is stopped at a time t14.

The application timing and stop timing of the AC-component development bias voltage and the driving timing of the development sleeve 21 are not limited to the above configuration. The AC-component development bias voltage may be applied at the same timing as the DC-component development bias voltage, or the AC-component development bias voltage may be applied at timing from then on until the leading end of the color image portion reaches the development nip region N.

For the stop timing, the AC-component development bias voltage may be applied at the same timing as the DC-component development bias voltage, or the AC-component development bias voltage may be applied at any timing until the DC-component development bias voltage is turned off since the image portion passes through the development nip region N. The effect of the invention is not reduced at all even in such configurations. However, when the timing is set as described in the embodiment, the band-like toner adhesion amount is previously suppressed, so that the problem can hardly be generated.

The driving timing of the development sleeve 21 is not limited to the configuration of the embodiment, but the development sleeve 21 may be driven at any timing as long as the development sleeve 21 is driven while the image portion passes through the development nip region N. However, when the timing is set as described in the embodiment, the band-like toner adhesion amount is previously suppressed, so that the problem can hardly be generated. When the driving time is shortened as much as possible, advantageously degradation of the developer is hardly generated.

As described above, in the configuration of the embodiment, because the high priority is put on the prevention of the carrier adhesion to the photosensitive drum 1, the band-like toner image adheres in front and at the back of the image portion on the photosensitive drum 1. The band-like toner image adheres in front and at the back of the image portion on the photosensitive drum 1, particularly the toner not lower than that corresponding to the solid image adheres to the band-like toner image formed at bias stop timing, and the width of the band-like toner image is substantially equal to the development nip width.

On the other hand, for the bias application timing, the toner in the development nip region N is ejected to the photosensitive drum 1 in the form of the band-like toner image at the bias stop timing, and the toner in the development nip region N is run out. Therefore, usually the toner adhesion amount at the bias application timing can substantially be neglected compared with the band-like toner image formed at the bias stop timing.

Thus, the band-like toner image formed at the bias stop timing is one in which the amount of toner placed on the intermediate transfer belt 7 is not lower than that of the solid image, which causes the in-machine contamination such as toner dispersal and fusion on belt when the rotation of the intermediate transfer belt 7 is stopped to leave the toner in the machine while the band-like toner image formed at the bias stop timing remains on the intermediate transfer belt 7. Accordingly, it is necessary that the intermediate transfer belt 7 be continuously rotated until the band-like toner image is conveyed to the belt cleaner 12 and removed and recovered. However, the continuous rotation of the intermediate transfer belt 7 results in the problem in that the rotation time becomes lengthened after the recording operation is ended.

In the four-color full color electrophotographic image forming apparatus of FIG. 1, when particularly the bias stop timing is configured as described above, the band-like toner image is formed in each color according to the bias stop timing of each color in ending the recording operation. The band-like toner images are sequentially primary-transferred onto the intermediate transfer belt 7 at the same time by electric action of and the pressing force of the primary transfer roller 5, when the toner image of each color is transferred to the intermediate transfer belt 7 by the primary transfer roller 5. Therefore, the toner image of each color is superposed on the intermediate transfer belt 7. Similarly, the band-like toner image of each color is transferred onto the intermediate transfer belt 7 according to the bias stop timing of each color. As a result, in the four-color full color image forming apparatus of the embodiment, it is necessary that all the four-color band-like toner images be conveyed to the belt cleaner 12 to prevent the contamination in the machine, and it is necessary that all the four-color band-like toner images pass through the secondary transfer nip T2 located in the course of the conveyance at that time.

Thus, in stopping the recording operation, the band-like toner image formed according to the bias stop timing of each color in association with the rotation of the intermediate transfer belt 7 is conveyed to the secondary transfer nip T2. Because the band-like toner image is not in contact with the transfer material P, the band-like toner image is brought into direct contact with the secondary transfer roller 9, and the band-like toner image is transferred to the secondary transfer roller 9 by the electric action and the pressing force, which contaminates the secondary transfer roller 9.

As described in the problem to be solved by the invention, sometimes the toner cannot be removed by one-time cleaning with the roller cleaner 11, when the four-color band-like toner images in which the amount of toner placed on the intermediate transfer belt 7 is not lower than the solid image are transferred to the secondary transfer roller 9. Therefore, the decrease in efficiency caused by the backside dirt of the transfer material P or the waiting for cleaning the secondary transfer roller 9 is easily generated.

(Secondary Transfer Roller Cleaning)

The secondary transfer roller 9 and the cleaning method thereof will be described.

The secondary transfer roller 9 has the configuration including at least an elastic rubber layer and a coating layer (surface layer). The elastic rubber layer is formed by a foam layer in which carbon blacks whose cell diameter ranges from 0.05 to 1.0 mm are dispersed. The coating layer whose thickness ranges from 0.1 to 1.0 mm is made of a fluororesin-system material ionic conductive polymers are dispersed. In the coating layer, surface roughness Rz is more than 1.5 μm in consideration of the conveyance of the transfer material P.

The invention obtains the effect irrespective of the surface layer of the secondary transfer roller 9. Conventionally, frequently the surface layer of the secondary transfer roller is roughened from the standpoint of conveyance of the transfer material P.

Similarly the secondary transfer roller 9 whose surface layer is roughened is used in the embodiment. The surface layer of the secondary transfer roller 9 has the surface roughness Rz of 2.5 μm. In the blade method in which the cleaning blade is used as the roller cleaner for cleaning the secondary transfer roller 9, the use of the secondary transfer roller 9 having the surface roughness Rz of 2.5 μm can remove the low-density toner such as the development fog toner adhering to the non-image portion by the development device 4.

On the other hand, in order to sufficiently clean the high-density image such as the solid image, it is necessary to enhance an abutting pressure of the cleaning blade or an abutting angle to increase a linear pressure at the nip portion of the cleaning blade. However, because both the secondary transfer roller and the cleaning blade are formed by the elastic member, a large frictional force is generated between the secondary transfer roller and the cleaning blade, which results in the problem in that the cleaning blade adhering to the secondary transfer roller is easily curled up when the linear pressure is increased at the nip portion.

In order to clean the secondary transfer roller 9 whose surface layer is roughened, an electrostatic cleaning method in which an electrostatic fur brush is used can be adopted instead of the blade method. The electrostatic cleaning method is one in which the bias voltage having an opposite polarity from a polarity of the toner is applied to the conductive fur brush to transfer the toner on the secondary transfer roller 9 to the fur brush. The electrostatic cleaning method has an advantage in that the good cleaning can be performed to the secondary transfer roller 9 whose surface layer is roughened because the leading end of the fur brush invades into the roughened part of the surface layer.

Although the electrostatic fur brush has a little restriction in terms of the surface shape of the secondary transfer roller 9 which is of the cleaning target, the electrostatic cleaning method is inferior to the blade method in cleaning ability because the cleaning is electrostatically performed, and the high-density toner can hardly sufficiently be removed. Therefore, after cleaning the high-density toner such as the solid image, the surface layer of the secondary transfer roller 9 is contaminated by the toner, and the toner is transferred to the transfer material P, which results in a risk of causing the backside contamination or the image defect during the tow-side copy.

Thus, in the case where the blade method or the electrostatic cleaning method is adopted in the roller cleaner 11, there is the risk of generating the problem such as the backside contamination in the case of the high-density toner such as the solid image.

(Recovery of Band-Like Toner by Application of Reverse Transfer Bias Voltage to Primary Transfer Roller)

Therefore, the embodiment adopts the following configuration. That is, the reverse transfer bias voltage having the opposite polarity (negative) from the polarity of the image portion is applied to the primary transfer roller 5 before the band-like toner image formed on the photosensitive drum 1 according to the bias stop timing of each color reaches the primary transfer nip T1. Therefore, the band-like toner image is removed and recovered by the drum cleaner 6 on the photosensitive drum 1 while not transferred onto the intermediate transfer belt 7.

In forming the four-color full color image, sometimes the four-color band-like toner images formed according to the bias stop timing of each color contaminates the secondary transfer roller 9. A large amount of time is required for the rotation of the intermediate transfer belt 7 after the end of the recording operation. This is because all the band-like toner images, in which a large amount of toner placed on the intermediate transfer belt 7 causes the contamination in the machine when left in the machine, are required to be conveyed to the belt cleaner 12 located on the downstream side of the secondary transfer roller 9 in order to remove and recover the band-like toner images from the intermediate transfer belt 7. In the case where a conveyance distance (conveyance time) from the primary transfer nip T1 of each color to the belt cleaner 12 is lengthened by upsizing of the machine due to the needs of multi color, the time necessary to the rotation of the intermediate transfer belt 7 is further lengthened after the end of the recording operation.

Therefore, the band-like toner image is recovered by not the belt cleaner 12 but the drum cleaner 6. As described above, in the embodiment, the reverse transfer bias voltage having the opposite polarity from the polarity of the image portion is applied to the primary transfer roller 5 before the band-like toner image formed at the rear end of the charged portion in ending the recording operation reaches the primary transfer nip T1. This enables the band-like toner image to be removed and recovered with the drum cleaner 6 on the photosensitive drum 1 while the band-like toner image is not transferred onto the intermediate transfer belt 7.

Figure 4:
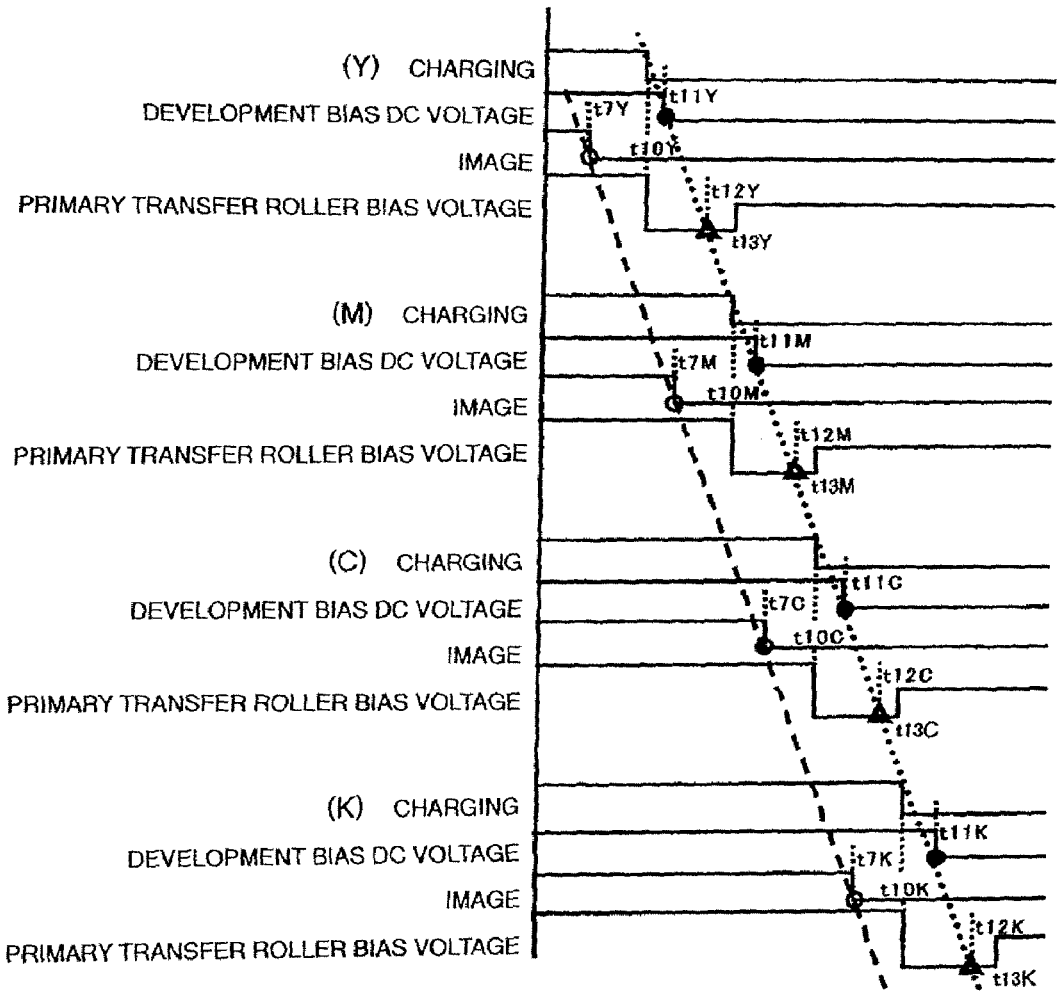
FIG. 4 is a timing chart explaining DC component off-timing and primary transfer bias on-timing of a charging bias voltage and a development bias voltage for each color.

FIG. 4 is a timing chart collectively illustrating only an important part of the application bias voltage in the image forming portion of each color when the recording operation is ended. After the rear end of the charged portion of each of the yellow (Y), magenta (M), cyan (C), black (K) reaches the development nip region N of each color, the band-like toner is formed on the photosensitive drum 1 until each of the development bias stop times t11Y, t11M, t11*c*, and t11K. The reverse transfer bias voltage having the opposite polarity from the polarity of the image portion is applied to the primary transfer roller 5 at each of times t10Y, t10M, t10C, and t10K before each of times t12Y, t12M, t12C, t12K at which the band-like toner image passes through the primary transfer nip T1. After the band-like toner image passes through the primary transfer nip T1, the application of the reverse transfer bias voltage is stopped at times t13Y, t13M, t13C, and t13K.

The band-like toner image formed at the rear end of the charged portion in ending the recording operation is formed until the rear end of the charged portion passes through the development nip region N to stop the application of the CD-component development bias voltage. As described above, like the embodiment, when the driving of the development sleeve 21 before the rear end of the charged portion reaches the development nip region N, the band-like toner image at the rear end of the charged portion is formed while having the substantially same width as the development nip region N, and the band-like toner image has the substantially same width in each color.

On the other hand, the amount of toner placed on the band-like toner image of each color is determined by the contrast potential Vcont between the surface potential and the development bias voltage Vdc applied to the development sleeve of each color when the photosensitive drum 1 has the surface potential of 0 V. Therefore, possibly the amount of toner placed on the band-like toner image of each color largely depends on the setting value of the development bias voltage Vdc during the image formation.

As described above, because the large amount of toner is placed on the band-like toner image compared with the usual solid image, the large amount of toner is primary-transferred to the intermediate transfer belt by the pressing force of the primary transfer roller 5 compared with the usual solid image. Therefore, in order to leave the band-like toner image on the photosensitive drum 1, it is necessary that the reverse transfer bias voltage compensating for the primary-transferred toner be applied to the primary transfer roller 5.

However, when the reverse transfer bias voltage is excessively applied to the photosensitive drum 1, the image defect is undesirably caused in the memory by proximity discharge generated between the photosensitive drum 1 and the primary transfer roller 5.

Accordingly, in the embodiment, the absolute value of the reverse transfer bias voltage applied to the primary transfer roller 5 of each color is individually controlled according to the absolute value of the development bias voltage Vdc which determines the amount of toner placed on the band-like toner image as illustrated in FIG. 5.

Specifically, the absolute value of the reverse transfer bias voltage is controlled such that the reverse transfer bias voltage having the larger absolute value is applied to the photosensitive drum having the large absolute value of the development bias voltage rather than the photosensitive drum having the small absolute value of the development bias voltage. That is, assuming that Va is an absolute value of the reverse transfer bias voltage when an absolute value V1 of the development bias voltage is applied while Vb is an absolute value of the reverse transfer bias voltage when an absolute value V2 of the development bias voltage is applied, the reverse transfer bias voltage is set such that Va>Vb is obtained in the case of V1>V2.

This enables the band-like toner to be left on the photosensitive drum 1 to an extent in which the image defect is not generated in the memory.

According to the above configuration, the band-like toner image which is formed at the rear end of the charged portion in ending the recording operation to cause the in-machine contamination when left in the machine can be removed and recovered by the drum cleaner 6 on the photosensitive drum 1. Unlike the conventional technique, it is not necessary that the band-like toner image be removed and recovered by conveying the band-like toner image through the intermediate transfer belt 7 to the belt cleaner 12 located on the down stream side of the secondary transfer roller 9. Therefore, the contamination of the secondary transfer roller 9 can be prevented in the configuration of the embodiment. Furthermore, the time required for the rotation of the intermediate transfer belt 7 after the end of the recording operation can largely be shortened by the distance (conveyance time) in which the band-like toner is conveyed from the primary transfer nip T1 to the belt cleaner 12.

Although the image forming apparatus which forms the four-color color image is described in the embodiment, the number of colors in the color image is not limited to the four colors. For example, the invention can be applied to the image forming apparatus which forms the multi-color image having at least two colors.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-270267, filed Oct. 2, 2006, which is hereby incorporated by reference herein in its entirety.

What is claimed is:

1. An image forming apparatus comprising:

a photosensitive body;

a charging device which applies a charging bias voltage to said photosensitive body;

an exposing device which exposes and forms an electrostatic image on said photosensitive body charged by said charging device;

a developing device which charges a developer, including toner and carrier, and develops the electrostatic image on said photosensitive body at a developing portion;

an intermediate transfer member which contacts with the photosensitive body;

a primary transfer device which transfers a developed image, formed on said photosensitive body, to said intermediate transfer member by applying a transfer bias voltage;

a primary cleaning device which cleans toner remaining on a surface of said photosensitive body not transferred to said intermediate transfer member by said primary transfer device;

a secondary transfer device which transfers the developed image on said intermediate transfer member to a recording material;

a secondary cleaning device which cleans toner remaining on a surface of said intermediate transfer member not transferred to the recording material by said secondary transfer device; and a control device which, in an ending process of an image forming operation and after stopping the application of the charging bias voltage in the ending process, stops the application of a developing bias voltage after a front of a non-charged area of said photosensitive body where the charging bias voltage is not applied passes said developing portion so as to cause toner to adhere at the non-charged area of said photosensitive body, and which applies a bias voltage having an opposite polarity from a bias voltage for an image forming process of the image forming operation to said primary transfer device, so as not to transfer the toner to said intermediate transfer member and so as to remove the toner by said primary cleaning device.

2. The image forming apparatus according to claim 1, wherein said control device, in the ending process of the image forming operation, applies the voltage having an opposite polarity from the transfer bias voltage to said primary transfer device in accordance with an absolute value of the developing bias voltage applied by said developing device.

3. The image forming apparatus according to claim 1, the image forming apparatus further comprising:

a plurality of image forming portions each having said photosensitive body, said charging device, said developing device, said exposing device, said primary transfer device, and said primary cleaning device, wherein said control device, in the ending process of the image forming operation, stops applying each of the plurality of charging bias voltages by each of said plurality of charging devices in disposing order of the image forming portions from an upstream side in a rotating direction of said intermediate transfer member.

4. The image forming apparatus according to claim 1, wherein said primary cleaning device that cleans the surface of said photosensitive body is a cleaning blade, and said secondary cleaning device that cleans the surface of said intermediate transfer member is a fur brush.

5. The image forming apparatus according to claim 1, wherein an absolute value of the transfer bias voltage applied to said primary transfer device in the ending process of the image forming operation is larger than an absolute value of the transfer bias voltage applied to said primary transfer device during the forming process of the image forming operation.

* * * * *